US007640621B2

(12) United States Patent
Cloud, III

(10) Patent No.: US 7,640,621 B2
(45) Date of Patent: Jan. 5, 2010

(54) THERMAL PROTECTION SYSTEM FOR ELECTRICAL APPLIANCE

(75) Inventor: John A. Cloud, III, Nicholasville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 627 days.

(21) Appl. No.: 11/113,643

(22) Filed: Apr. 25, 2005

(65) Prior Publication Data

US 2005/0235452 A1 Oct. 27, 2005

Related U.S. Application Data

(60) Provisional application No. 60/565,329, filed on Apr. 26, 2004.

(51) Int. Cl.
*A47L 5/00* (2006.01)
*G05D 23/00* (2006.01)

(52) U.S. Cl. ..... 15/319; 15/339; 15/412; 318/472; 318/473

(58) Field of Classification Search ..... 15/319, 15/339, 412; 318/471–473
See application file for complete search history.

(56) References Cited

U.S. PATENT DOCUMENTS

| | | | | |
|---|---|---|---|---|
| 2,706,411 | A | 4/1955 | Bircher | |
| 3,695,006 | A * | 10/1972 | Valbona et al. | 96/420 |
| 4,512,057 | A | 4/1985 | Laing et al. | |
| 4,852,208 | A | 8/1989 | Morishita et al. | |
| 5,153,965 | A | 10/1992 | Prosser et al. | |
| 5,440,216 | A * | 8/1995 | Kim | 318/587 |
| 5,784,753 | A * | 7/1998 | Kaczmarz et al. | 15/319 |
| 6,055,141 | A * | 4/2000 | Dorschky et al. | 361/25 |
| 6,167,588 | B1 * | 1/2001 | Dyson | 15/339 |
| 6,297,607 | B1 * | 10/2001 | Becker | 318/471 |
| 6,484,352 | B2 | 11/2002 | Huebsch et al. | |
| 6,553,611 | B2 * | 4/2003 | Huebsch et al. | 15/339 |
| 6,632,018 | B2 | 10/2003 | Isshiki et al. | |

* cited by examiner

*Primary Examiner*—Randall Chin
(74) *Attorney, Agent, or Firm*—King & Schickli, PLLC

(57) ABSTRACT

An electrical appliance includes a housing carrying a drive motor, a temperature sensor and a controller. The temperature sensor monitors the operating temperature of the drive motor. The controller is responsive to the temperature sensor. The controller adjusts the current applied to the drive motor in response to a high temperature condition detected by the temperature sensor.

9 Claims, 2 Drawing Sheets

THERMAL PROTECTION SYSTEM FOR ELECTRICAL APPLIANCE

This application claims the benefit of U.S. Provisional Patent Application Ser. No. 60/565,329 filed on Apr. 26, 2004.

TECHNICAL FIELD

The present invention relates generally to the electrical appliance field and, more particularly, to a thermal protection system for electrical appliances in general and, more particularly, to an electrical appliance incorporating such a system.

BACKGROUND OF THE INVENTION

Substantially any electrical appliance may at one time or another be subjected to operating extremes which may cause the operating temperatures of the appliance to rise to a sufficiently high temperature so as to potentially cause damage to the mechanical workings of the device or even its housing or enclosure. The present invention relates to an apparatus and method for (1) sensing when the operating temperature of an electrical appliance rises above a predetermined high temperature condition and (2) adjusting the current flow to at least a portion of the device in response to sensing such a condition.

SUMMARY OF THE INVENTION

The present invention broadly relates to any electrical appliance comprising a housing and a drive motor, temperature sensor and controller all carried on the housing. The temperature sensor monitors an operating temperature of the drive motor. The controller is responsive to the temperature sensor and adjusts current applied to the drive motor in response to a high temperature condition detected by the temperature sensor.

More particularly, the present invention relates to an electrical appliance such as a vacuum cleaner including a porous filter bag or a dirt cup carried on the housing. Further the electrical appliance includes a rotary agitator carried on the housing. The electrical appliance may comprise a canister type vacuum cleaner or an upright type vacuum cleaner.

In addition the electrical appliance may include a restart actuator connected to the controller. Upon the temperature sensor detecting the high temperature condition, the controller maintains the current applied to the drive motor in an adjusted condition until both the motor cools below the high temperature condition and the restart actuator is engaged.

The electrical appliance may also include a position sensor connected to the controller. Upon the temperature sensor detecting the high temperature condition, the controller maintains current applied to the drive motor in an adjusted condition until both the motor cools below the high temperature condition and the position sensor detects the electrical appliance in a restart position. The position sensor may, for example, comprise an accelerometer or a mercury switch.

Still further the electrical appliance may include an indicator for indicating when the high temperature condition has been detected. The indicator may, for example, be selected from a light source and/or a sound source.

The present invention may also be defined as a vacuum cleaner comprising a housing and a suction generator, temperature sensor, rotary agitator and controller all carried on the housing. The suction generator includes a drive motor. The temperature sensor monitors the operating temperature of that drive motor. The controller is responsive to the temperature sensor and adjusts current applied to the drive motor in response to a high temperature condition detected by the temperature sensor.

The vacuum cleaner may include a porous filter bag or a dirt cup carried on the housing. The vacuum cleaner may be of the canister type or an upright type. Further, the drive motor may also drive the rotary agitator in addition to the suction generator.

The present invention may also be defined as a vacuum cleaner comprising a housing and a dirt collector carried on the housing. The vacuum cleaner also includes a suction generator having a first drive motor. Additionally, the vacuum cleaner includes a first temperature sensor for monitoring an operating temperature of the first drive motor. Further the vacuum cleaner includes a rotary agitator and a second drive motor for driving that rotary agitator. Additionally, the vacuum cleaner includes a second temperature sensor for monitoring the operating temperature of the second drive motor. A controller carried on the housing is responsive (a) to the first temperature sensor and adjusts current applied to the first drive motor in response to a high temperature condition detected by the first temperature sensor and (b) to the second temperature sensor and adjusts current applied to the drive motor in response to a high temperature condition detected by the second temperature sensor.

Still further describing the invention, the vacuum cleaner includes a restart actuator connected to the controller. Upon one of the two temperature sensors detecting a high temperature condition, the controller maintains current applied to the first or second drive motor in an adjusted condition until the first or second drive motor cools below the high temperature condition and the restart actuator is engaged.

The vacuum cleaner may also include a position sensor connected to the controller. Upon the first or second temperature sensor detecting a high temperature condition, the controller maintains current applied to either drive motor operating at a high temperature in an adjusted condition until the drive motor cools below the high temperature condition and the position sensor detects the vacuum cleaner in a restart position. The position sensor is typically an accelerometer or a mercury switch.

In accordance with yet another aspect of the present invention, a method is provided for thermally protecting an electrical device. The method comprises equipping the electrical device with a temperature sensor and a controller responsive to the temperature sensor. Further the method includes the step of adjusting the current applied to at least a portion of the electrical device in response to the temperature sensor sensing a high temperature condition. In addition the method includes the step of maintaining the current applied to at least a portion of the electrical device in the adjusted condition until both the high temperature operating portion of the electrical device cools below the high temperature condition and an additional predetermined restart condition is met. The method of the present invention may be more specifically defined as a method of thermally protecting a vacuum cleaner.

In accordance with yet another aspect of the present invention an electrical device is provided. The electrical device comprises an electric motor, a temperature sensor monitoring an operating temperature of the electric motor and a controller responsive to the temperature sensor. The controller adjusts the current applied to the electric motor in response to a high temperature condition detected by the temperature sensor. The device may further include a restart actuator connected to the controller. Upon the temperature sensor detecting a high temperature condition, the controller maintains an adjusted condition until both the motor cools below the high temperature condition and the restart actuator is engaged. The device may also include a position sensor connected to the controller. Upon the temperature sensor detecting the high temperature condition, the controller maintains the adjusted condition until both the motor cools below the high temperature condition and the position sensor detects the electrical device in a restart position.

In the following description there is shown and described multiple embodiments of this invention simply by way of illustration of several modes best suited to carry out the invention. As it will be realized, the invention is capable of other different embodiments and its several details are capable of modification in various, obvious aspects all without departing from the invention. Accordingly, the drawing and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain certain principles of the invention. In the drawings.

Reference will now be made in detail to the present preferred embodiment of the invention, an example of which is illustrated in the accompanying drawings.

DETAILED DESCRIPTION OF THE INVENTION

Figure 1:
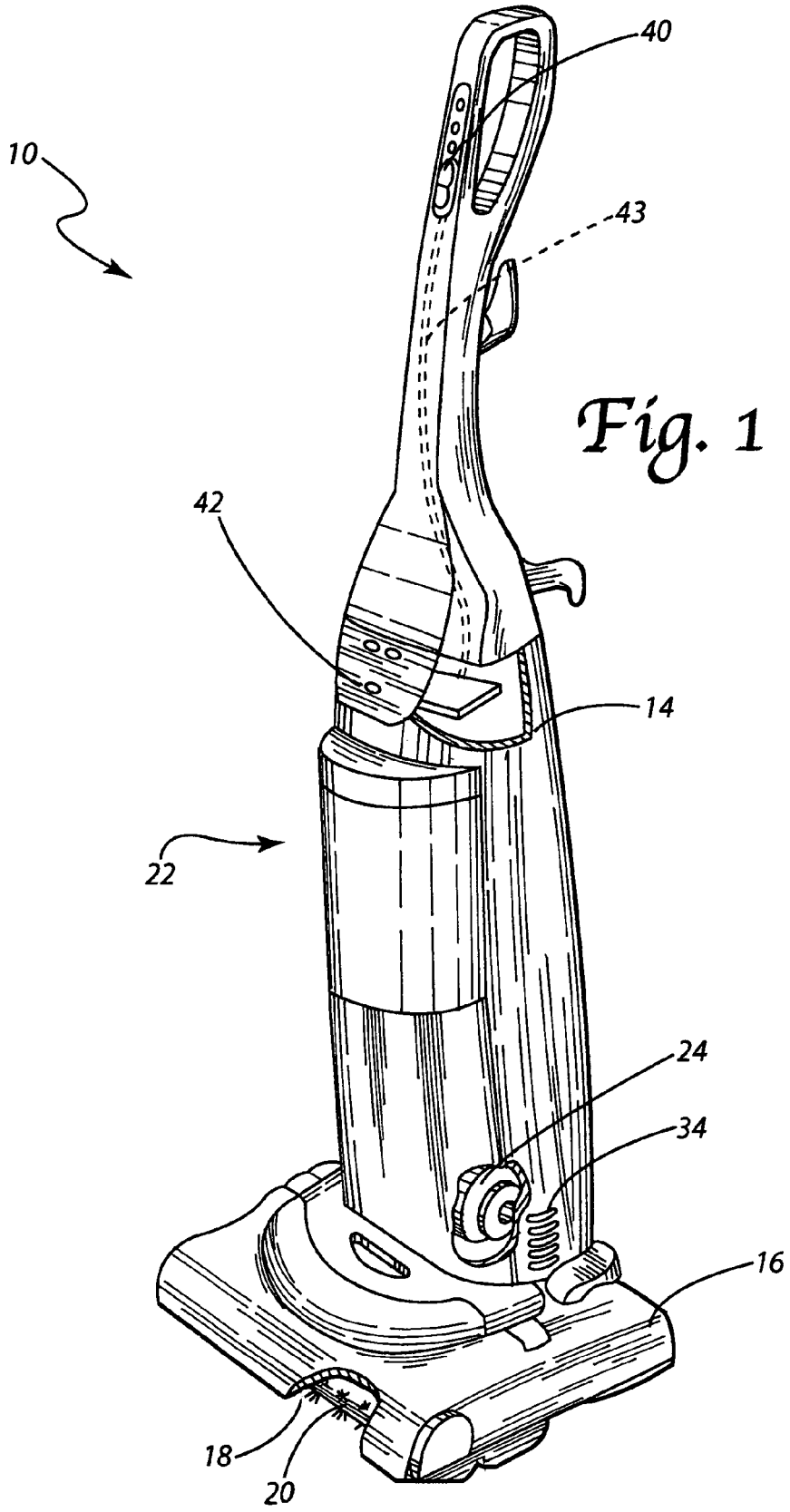
FIG. 1 is a perspective view of an upright vacuum cleaner illustrating just one possible embodiment of the present invention.
Figure 2:
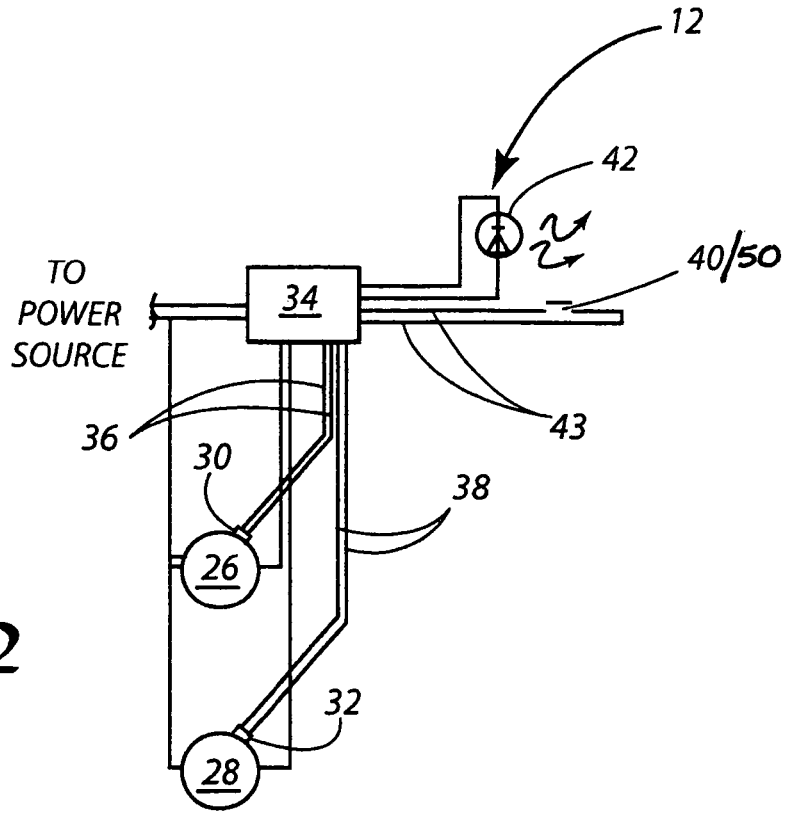
FIG. 2 is a schematical view of one possible system for sensing a high temperature condition in an electrical appliance such as the vacuum cleaner shown in FIG. 1.
Figure 3:
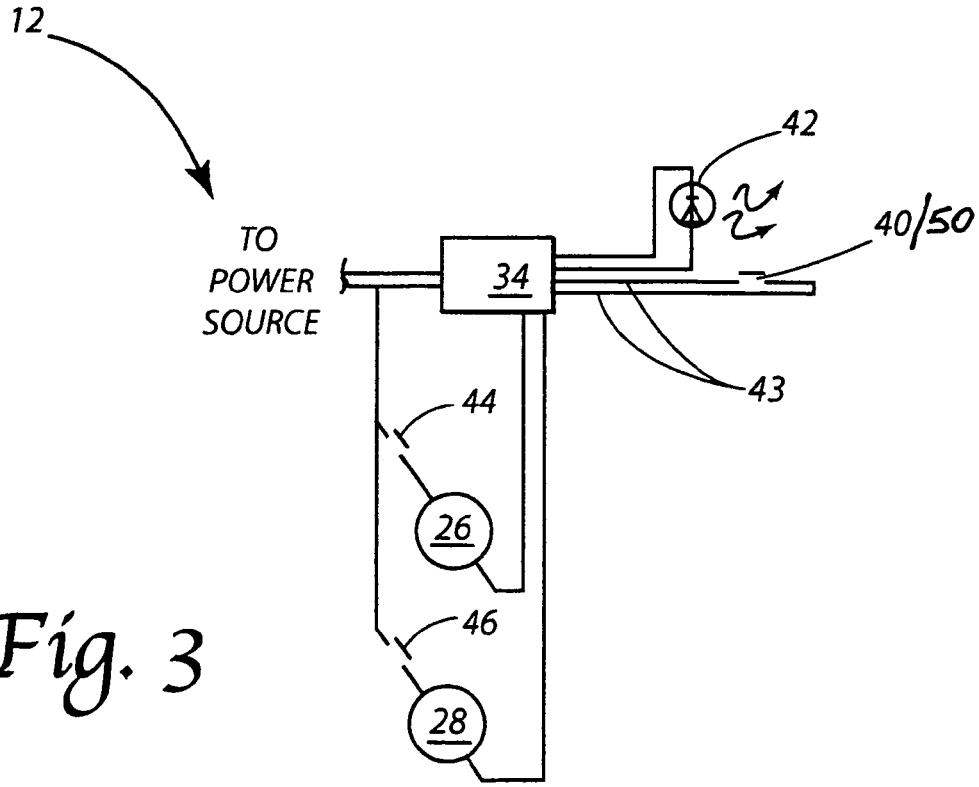
FIG. 3 is a schematical view of another embodiment for sensing a high temperature condition in an electrical appliance such as the upright vacuum cleaner of FIG. 1.

Reference is now made to FIG. 1 illustrating a vacuum cleaner 10 equipped with the thermal protection system 12 of the present invention as illustrated by alternative embodiments in FIGS. 2 and 3. The vacuum cleaner 10 in the illustrated embodiment is an upright vacuum cleaner including a handle or canister assembly 14 pivotally connected to a nozzle assembly 16. The nozzle assembly 16 includes a suction inlet 18. A rotary agitator 20 is mounted in the suction inlet 18. The rotary agitator 20 includes brushes, wipers, beater bars, bristle tufts or the like and is rotated relative to the nozzle assembly 16 to beat dirt and debris from an underlying carpet or rug being cleaned.

The canister or handle assembly 14 includes a dirt collector 22, which may take the form of a porous filter bag or dirt cup, and a suction generator 24. Typically the suction generator 24 comprises a fan driven by a motor 26. In some vacuum cleaners 10, the motor 26 that drives the suction fan also drives the rotary agitator 20. In other vacuum cleaners 10, a second, separate motor 28 is provided for driving the rotary agitator 20.

In use, the rotary agitator 20 beats dirt and debris from the nap of an underlying rug or carpet being cleaned. That dirt and debris is then drawn into the dirt collector 22 through the suction inlet 18 by means of the negative pressure generated by the suction generator 24. The dirt and debris is trapped in the dirt collector 22 while the now clean air is directed over the motor 26 of the suction generator 24 to provide cooling before being exhausted into the environment.

Under certain operating conditions the motor 26 of the suction generator and the motor 28 of the rotary agitator (if present), may become overheated. In extreme cases this has the potential to result in damage to the motor 26 or 28 or even the housing of the nozzle assembly 16 or canister assembly 14 containing the motor. Advantageously, the thermal protection system 12 of the present invention eliminates this cause for concern.

As illustrated in the embodiment shown in FIG. 2, the thermal protection system 12 of the present invention includes a first temperature sensor in the form of a thermocouple 30 connected to the suction generator motor 26, a second temperature sensor in the form of a thermocouple 32 connected to the rotary agitator motor 28 and a controller 34, such as a dedicated microprocessor, connected to the thermocouples 30, 32 by lead wires 36, 38 respectively. As should be further appreciated the illustrated embodiment also discloses a restart actuator 40 in the form of a push button switch and a high temperature indicator in the form of a light source 42.

During normal vacuum cleaner operation, the first thermocouple 30 monitors the operating temperature of the suction generator motor 26 and the second thermocouple 32 monitors the operating temperature of the rotary agitator motor 28. More specifically, each thermocouple 30, 32 sends an electrical control signal along the respective lead lines 36, 38 to the controller 34 representative of the sensed operating temperature. So long as the operating temperature of both motors 26, 28 stays below a predetermined temperature, normal vacuum cleaner operation is maintained. In contrast, when either thermocouple 30, 32 senses that either motor 26, 28 is operating above the predetermined temperature (that is, detects a high temperature condition) such a condition is indicated by the signal sent along the appropriate lead lines 36, 38. The controller 34 responds to the high temperature condition signal by adjusting the electrical current applied to the motor 26, 28 for which the high temperature condition has been detected. For most applications that means the controller 34 will interrupt the application of current to the motor 26, 28 in question. For certain applications, however, this may simply mean decreasing the current being applied.

For those vacuum cleaners 10 equipped with an indicator 42, the controller 34 also energizes the indicator in response to the detected high temperature condition. In the embodiment illustrated in FIG. 2 the indicator 42 is a light source (e.g. incandescent bulb, LED) that is illuminated. It should be appreciated, however, that the indicator 42 could just as easily be a sound source such as a buzzer or a combination of the two.

When current application to the motor 26, 28 in question is interrupted by operation of the controller 34, that motor begins to cool. Once it cools below the predetermined temperature that establishes the high temperature condition, the motor 26, 28 in question is not immediately re-energized. Instead, the current adjustment, in this case an interruption of the application of current, is maintained until the operator also engages the restart actuator or switch 40. Accordingly, it should be appreciated that once a motor 26 or 28 has been detected as operating above the predetermined temperature or in a high temperature condition, it is not re-energized until two conditions are met. The first is the motor 26 or 28 has cooled below the predetermined temperature. The second is the operator has engaged the restart actuator 40 and closed the circuit or lead lines 43 leading to the controller 34.

An alternative embodiment of the thermal protection system 12 of the present invention is illustrated in FIG. 3. In this embodiment the temperature sensors are first and second bimetallic switches 44, 46 instead of first and second thermocouples 30, 32. The operation of the thermal protection system 12 is, however, similar to the operation described above with respect to the first embodiment. More particularly, if the suction generator motor 26 or the rotary agitator motor 28 operates above the predetermined temperature, the contacts of the bimetallic switch 44, 46 associated with that motor separate thereby interrupting power to the motor in question. This interruption of power is detected by the controller 34 which then energizes the indicator 42 to indicate the high temperature condition. Full operating current is not reapplied to the motor 26 or 28 in question until two conditions are met. The first is that the motor 26 or 28 has cooled sufficiently so that the contacts of the bimetallic switch 44 or 46 again engage. This alone is, however, not sufficient to reestablish the full current supply to the motor. In addition the operator must engage the restart actuator 40 and close the circuit or lead lines 43 leading to the controller 34.

While a restart actuator 40 is illustrated in the FIG. 2 and 3 embodiments, it should be appreciated that other structures could be substituted for the restart actuator. For example, a position sensor 50 could be provided in the circuit 43 in place of the restart actuator. The controller 34, operating in response to the position sensor 50, in the form of, for example, an accelerometer or a mercury switch could prevent the re-energization of the motor 26 or 28 unless the vacuum cleaner 10 is returned to and oriented in a proper starting position. Such a position could, for example, be the storage position with the canister or handle assembly 14 in the upright position relative to the nozzle assembly 16 as illustrated in FIG. 1. In this situation if the vacuum cleaner 10 is in any other position, such as, for example, lying down on the floor, the controller 34 will prevent restarting of the motor even if the motor has cooled below the predetermined temperature.

In still another alternative embodiment the restart actuator 40 could be simply deleted from the circuit. In this situation restarting of the motor 26 or 28 would be possible only after the controller 34 has been de-energized by switching off the vacuum cleaner and/or disconnection of the vacuum cleaner from a power source: that is, unplugging the vacuum cleaner from a utility power outlet.

The foregoing description of several alternative embodiments of the present invention has been presented for purposes of illustration and description. It is not intended to be exhaustive or to limit the invention to the precise form disclosed. Obvious modifications or variations are possible in light of the above teachings.

For example, while an upright vacuum cleaner 10 has been illustrated in the drawing figures, the invention is equally applicable to other types of vacuum cleaners such as canister vacuum cleaners and handheld vacuum cleaners. Further, it is also applicable to battery powered vacuum cleaners of any type. In addition, the device is applicable to any form of vacuum cleaner whether it includes no agitators or more than one agitator, whether it is cyclonic or non-cyclonic design and whether it is a clean or dirty air system. Similarly, it applies to vacuum cleaners where the rotary agitator is driven by the suction generator motor or by its own, separate motor.

Still further, the present invention is also not limited to utilization in vacuum cleaners. It is also equally applicable to other electrical devices and appliances equipped with electric motors and for which overheating is a concern.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. An electrical appliance, comprising:

a housing;

a drive motor carried on the housing;

a temperature sensor carried on said housing, said temperature sensor monitoring an operating temperature of said drive motor;

a controller carried on said housing, said controller being responsive to said temperature sensor and adjusting current applied to said drive motor in response to a high temperature condition detected by said temperature sensor; and a position sensor, selected from a group consisting of an accelerometer and a mercury switch, connected to said controller, upon said temperature sensor detecting said high temperature condition, said controller maintaining current applied to said drive motor in an adjusted condition until both said motor cools below said high temperature condition and said position sensor detects said electrical appliance in a restart position.

2. The electrical appliance of claim 1, further including a porous filter bag carried on said housing.

3. The electrical appliance of claim 1, further including a dirt cup carried on said housing.

4. The electrical appliance of claim 1, further including a rotary agitator carried on said housing.

5. The electrical appliance of claim 1, wherein said electrical appliance is a canister type vacuum cleaner.

6. The electrical appliance of claim 1, wherein said electrical appliance is an upright type vacuum cleaner.

7. The electrical appliance of claim 1, further including an indicator indicating when said high temperature condition has been detected.

8. The electrical appliance of claim 7, wherein said indicator is selected from a group consisting of a light source and a sound source.

9. An electrical device, comprising:

an electric motor;

a temperature sensor monitoring an operating temperature of said electric motor;

a controller responsive to said temperature sensor and adjusting current applied to said electric motor in response to a high temperature condition detected by said temperature sensor; and a position sensor, selected from a group consisting of an accelerometer and a mercury switch, connected to said controller, upon said temperature sensor detecting said high temperature condition, said controller maintaining an adjusted condition until both said motor cools below said high temperature condition and said position sensor detects said electrical device in a restart position.

* * * * *